US010889432B2

(12) United States Patent
Li et al.

(10) Patent No.: US 10,889,432 B2
(45) Date of Patent: Jan. 12, 2021

(54) TRASH BAG ASSEMBLY FOR SMART TRASH RECEPTACLE, TRASH BAG FITTING DEVICE AND SMART TRASH RECEPTACLE

(71) Applicant: SHANGHAI TOWNEW INTELLIGENT TECHNOLOGY CO., LTD., Shanghai (CN)

(72) Inventors: Jianxiang Li, Shanghai (CN); Le Li, Shanghai (CN)

(73) Assignee: SHANGHAI TOWNEW INTELLIGENT TECHNOLOGY CO., LTD., Shanghai (CN)

( * ) Notice: Subject to any disclaimer, the term of this patent is extended or adjusted under 35 U.S.C. 154(b) by 212 days.

(21) Appl. No.: 16/198,510

(22) Filed: Nov. 21, 2018

(65) Prior Publication Data

US 2019/0382196 A1 Dec. 19, 2019

(30) Foreign Application Priority Data

Jun. 16, 2018 (CN) ..... 2018 1 0623434
Jul. 3, 2018 (CN) ..... 2018 1 0711673

(51) Int. Cl.
*B65F 1/06* (2006.01)
*B65F 1/00* (2006.01)
*B65F 1/16* (2006.01)

(52) U.S. Cl.
CPC ..... *B65F 1/06* (2013.01); *B65F 1/0006* (2013.01); *B65F 1/1623* (2013.01)

(58) Field of Classification Search
CPC ..... B65F 1/06; B65F 1/0006; B65F 1/1623; B65F 1/1415; B65F 1/141
(Continued)

(56) References Cited

U.S. PATENT DOCUMENTS 8,955,706 B2 2/2015 Gagnebin
9,085,404 B2 * 7/2015 Dunn ..... B65D 85/04
2015/0307273 A1 * 10/2015 Lyman ..... G01G 19/08 705/7.13

FOREIGN PATENT DOCUMENTS

CN 107021310 A 8/2017
CN 207001396 U 2/2018

* cited by examiner

*Primary Examiner* — King M Chu
(74) *Attorney, Agent, or Firm* — Rabin & Berdo, P.C.

(57) ABSTRACT

The present invention discloses a trash bag assembly, a trash bag fitting device and a smart trash receptacle. The trash bag assembly includes a storage body and a lid. The storage body defines a first opening and an annular trough extending externally around the first opening and configured to receive a trash bag. The lid defines a second opening corresponding to the first opening and is configured to cover an open end of the annular trough so as to form, together with one side wall of the annular trough, a gap serving as a bag exit. The trash bag fitting device is configured to fit a trash bag into a main body of a trash receptacle and includes a vacuum assembly and a motor for driving the vacuum assembly. The vacuum assembly includes an air inlet and an air outlet. The air inlet communicates with an air vent in an inner wall of the main body, with the air outlet in communication with the outside of the main body of the trash receptacle. A combination of the trash bag assembly and the trash bag fitting device enables fully-automatic trash bag fitting and bagging, an increased degree of automation and intelligence of the trash receptacle, low cost and higher replacement efficiency.

18 Claims, 9 Drawing Sheets

(58) Field of Classification Search
USPC ..... 220/495.08
See application file for complete search history.

TRASH BAG ASSEMBLY FOR SMART TRASH RECEPTACLE, TRASH BAG FITTING DEVICE AND SMART TRASH RECEPTACLE

TECHNICAL FIELD

The present invention relates to the field of accessories for smart trash receptacles and, in particular, to a trash bag assembly, a trash bag fitting device and a smart trash receptacle.

BACKGROUND

With the advancement of technology and the improvement of people's living standards, smart homes are increasingly becoming an indispensable part of our lives. At present, smart trash receptacles have been a focus of people's attention thanks to their characteristics of cleanliness, sanitariness and convenience of use.

While such trash receptacles prevalent on the contemporary market are typically capable of automatic opening, they cannot automatically fit a new trash bag in place by themselves. After a full trash bag is removed, manual intervention is still required for fetching a new trash bag and fitting it into the receptacle. Although some trash receptacles are equipped with trash bag storage means at the bottom or outside, which can save the trouble of fetching a trash bag, this could not really address the need for manual bag fitting. There are also some trash receptacles operating in a semi-automatic mechanical manner, in which an adhesive substance is applied on an outer side of a linking bar for opening a new trash bag to a certain extent at an open top of the trash receptacle. Despite some degree of semi-automation in the bag opening operation, this approach still relies on human intervention for further pulling out the new trash bag as well as for a series of additional actions for fully opening the bag to line it over the interior surface of the trash receptacle. As the bag opening operation accomplished by human intervention is inconsistent, and also since the approach itself is susceptible to degraded adhesiveness of the adhesive substance, high bag fitting quality could not be obtained.

At present, trash bags commonly available in the marketplace include flat-top bags, vest-style carrier bags and drawstring bags. Most of them are packaged in the form of rolls, while there are also some vest-style carrier bags folded into flat pieces as well as a minority of trash bags of the draw-out type. In spite of some common advantages such as package compactness and low manufacturing cost, these existing trash bags are disadvantageous in that their extraction and placement cannot be accomplished with simple mechanical means due to the very flexible nature of plastic materials from which they are fabricated, thus necessitating human intervention for replenishing a new bag into the trash receptacle. Moreover, although a trash bag has a nominal maximum storage capacity, in order to enable bagging, it usually has to be closed before the amount of trash deposited therein reaches the maximum capacity (typically when the former is ⅔ the latter). Otherwise, the bag cannot be adequately tied up, which is unfavorable to disposal of the contained trash because the bag closed in this way is apt to be accidentally opened when an environmental worker handles it, tending to cause scattering of the trash. This will not only harm the environment but will also lead to waste of trash bag resources. With drawstring trash bags as an example, while they allow relatively high capacity utilization, due to the limited capacities, they could not accommodate large trash items. In addition, they require manual fitting and are barely suitable for automatic fitting.

Therefore, how to store trash bags so as to allow their fully-automatic fitting and bagging by simple mechanical means, how to address the issue that the existing smart trash receptacles are incapable of simple and reliable automatic trash bag fitting and how to further increase their degree of automation and intelligence remain critical technical problems sought to be solved by those skilled in the art.

SUMMARY

In order to address the above problems to at least some extent, it is a first object of the present invention to provide a trash bag assembly suited to use in a smart trash receptacle, which is capable of fully-automatic trash bag fitting and bagging and can thus impart to the trash receptacle a higher degree of automation and intelligence.

A trash bag assembly for a smart trash receptacle comprises:

a storage body defining both a first opening allowing the passage of trash and an annular trough extending externally around the first opening and configured to receive a trash bag; and a lid defining a second opening corresponding to the first opening, the lid being configured to cover an open end of the annular trough so as to form, together with one side wall of the annular trough, a gap serving as a bag exit.

Preferably, the lid is integral with, or detachably connected to, the storage body.

Preferably, the trash bag assembly further comprises the trash bag which is a tubular structure having a continuous internal lumen extending throughout its entire length and two ends, at least one of which is open, and the trash bag is configured to be reciprocally folded into an annulus so as to be disposed within the annular trough.

Preferably, the side wall of the annular trough that defines the bag exit has a flared edge that is curved outwardly away from the annular trough.

Preferably, the open end of the annular trough is open in the same direction in which the first opening extends, and the annular trough has an inner side wall proximate the first opening and an outer side wall away from the first opening.

Preferably, the lid has an inner edge forming the gap together with the inner side wall and an outer edge connected to the outer side wall.

Preferably, the outer edge is pivotably connected at one end to the outer side wall of the annular trough.

Preferably, the lid defines a lip at the outer edge, which forms an interference fit with the outer side wall of the annular trough or is fastened thereto by snap-on means.

Preferably, the snap-on means comprise a recess and a block in cooperation with the recess, one of which is provided on an internal side of the lip and the other on the outer side wall of the annular trough.

Preferably, both the storage body and the lid are square annuli with chamfered corners.

Preferably, both the storage body and the lid are metal, plastic or paper components.

It is a second object of the present invention to provide a smart trash receptacle comprising the trash bag assembly as defined in any one of the above paragraphs.

Preferably, the storage body is integral with a body of the smart trash receptacle.

The technical solution provided by the present invention offers the following beneficial effects:

The trash bag assembly can be suitably used in a smart trash receptacle to impart a higher degree of automation and intelligence to it by providing fully-automatic trash bag fitting and bagging capabilities. Moreover, it can effectively prevent damage to the trash bag during its manufacturing, storage and transportation. As the annular trough may be sized differently according to the usage frequency and deployment place of the trash receptacle, the mass of the trash bag stored therein and its bagging length can be easily adjusted to promote resource conservation. Further, trash bag replenishment can be more easily accomplished with improved efficiency. As the trash bag assembly is an integral structure that can be easily assembled, its manufacturing and assembly can be achieved at lower cost.

The so constructed storage body and the lid can not only restrict the freedom of movement of the trash bag to only one direction, but can also maintain the trash bag in an always open configuration, thus dispensing with the need to open the trash bag during the automatic trash bag fitting process. As a result, a significantly simpler automatic trash bag fitting and bagging approach allowing easy implementation and operation is entailed.

The trash bag assembly can hold more trash substantially without restrictions. Moreover, the trash bag can be sealed and closed at any desired portion, depending on the amount of trash deposited therein, with the remaining length still available for further use. Thus, full utilization of its capacity can be achieved without waste of trash bag resources, and bagging and replacement can be performed in an automated fashion, increasing the degree of automation and intelligence of the conventional smart trash receptacle.

It is a third object of the present invention to provide a trash bag fitting device for a smart trash receptacle, which is suitable for use with an integral, weakness-free trash bag with a closed lower end. Preferably, the trash bag is accommodated in the trash bag assembly for the first object of the present invention described above. It can solve the problems of non-automatic or complex bag fitting and inconvenience of use arising from the use of conventional smart trash receptacles.

The trash bag fitting device for a smart trash receptacle provided in the present invention is configured to fit a trash bag into a main body of the trash receptacle and comprises a vacuum assembly and a motor for driving the vacuum assembly. The vacuum assembly is provided with an air inlet and an air outlet. The air inlet communicates with an air vent in an inner wall of the main body, with the air outlet in communication with the outside of the main body of the trash receptacle.

Preferably, the vacuum assembly is a centrifugal impeller type vacuum assembly or an axial-flow fan type vacuum assembly.

Preferably, the centrifugal impeller type vacuum assembly comprises a casing and a centrifugal impeller housed in the casing, wherein the air inlet is defined in the casing so as to axially oppose the centrifugal impeller, with the air outlet therein opposing the centrifugal impeller radially or being tangential thereto, and wherein the air inlet communicates with the air vent in the inner wall of the main body of the trash receptacle, with the air outlet in communication with the outside of the main body.

Preferably, the centrifugal impeller comprises blades each provided with, at a portion thereof in positional correspondence with the air inlet, a shoulder projecting toward the air inlet. The shoulder is sheet-like and integral with the blade on which it is provided.

Preferably, the centrifugal impeller further comprises a wheel to which all the blades are fixed and oriented perpendicular.

Preferably, the casing comprises a top piece and a bottom piece detachably coupled to the top piece, and the air inlet is defined in the top piece, with gaps between the top piece and the bottom piece providing the air outlet.

Preferably, the top piece is provided with at least two posts that project from a bottom side thereof and are snugly insertable into respective at least two recesses defined in the bottom piece.

Preferably, the centrifugal impeller is provided with a shaft hole in which a main shaft of the motor is received and secured, and the bottom piece is provided with a hole through which the main shaft is inserted.

Preferably, each of the blades is curved in shape.

Preferably, each of the blades has an end portion away from a center of the wheel that is thinner than its remaining portion.

It is a fourth object of the present invention to provide a smart trash receptacle comprising the trash bag fitting device as defined in any one of the above paragraphs.

In the trash bag fitting device for a smart trash receptacle provided in the present invention, comprising the vacuum assembly and the motor for driving the vacuum assembly that comprises the air inlet in communication with the air vent in the inner wall of the main body of the trash receptacle and the air outlet in communication with the outside of the main body, the vacuum assembly can evacuate the air from the main body of the trash receptacle through the air vent thereof, reducing the pressure in the main body below the ambient atmospheric pressure. As a result, the weakness-free trash bag is pushed down to the bottom of the receptacle. At this point, the motor can be turned off, with the trash bag having been fitted over internal surfaces of the main body. In this way, problems of non-automatic or complex bag fitting and inconvenience of use witnessed in conventional smart trash receptacles can be overcome.

It is a fifth object of the present invention to provide a smart trash receptacle comprising both the trash bag fitting device as described above in any one of the foregoing paragraphs in connection with the third object and the trash bag assembly as described above in any one of the foregoing paragraphs in connection with the first object.

When used in combination in a smart trash receptacle, the trash bag assembly and the trash bag fitting device of the present invention can impart to the smart trash receptacle capabilities of automatic trash bag fitting and immunize it from the problems of non-automatic or complex bag fitting and inconvenience of use witnessed in conventional smart trash receptacles.

It is to be understood that both the foregoing general description and the following detailed description are exemplary and explanatory only and are not restrictive of the present application.

Figure 1:
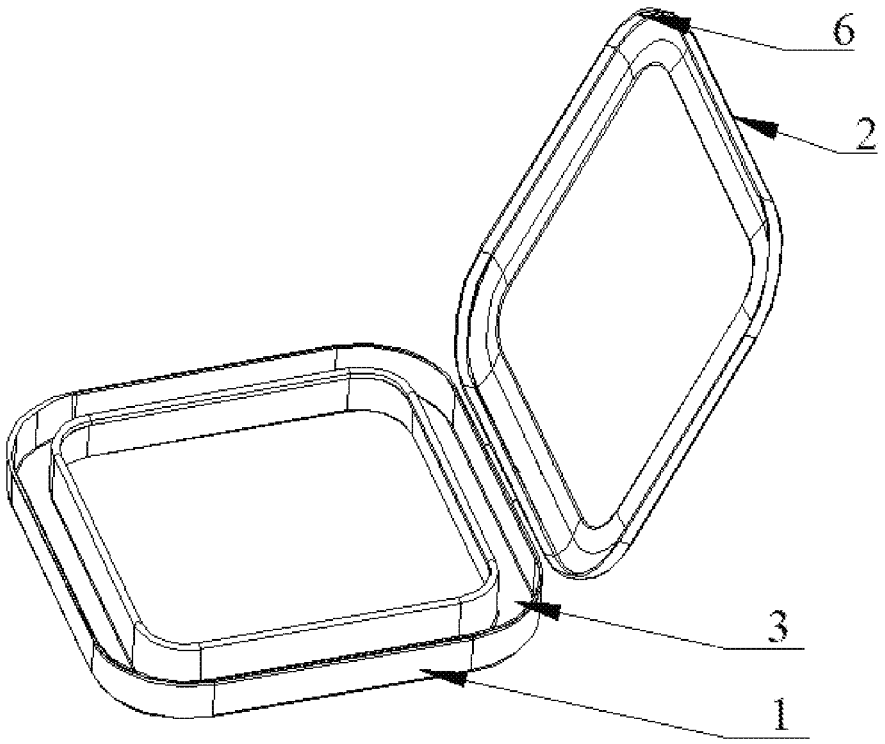
FIG. 1 is a structural view of a trash bag assembly for a smart trash receptacle according to an embodiment of the present invention.
Figure 2:
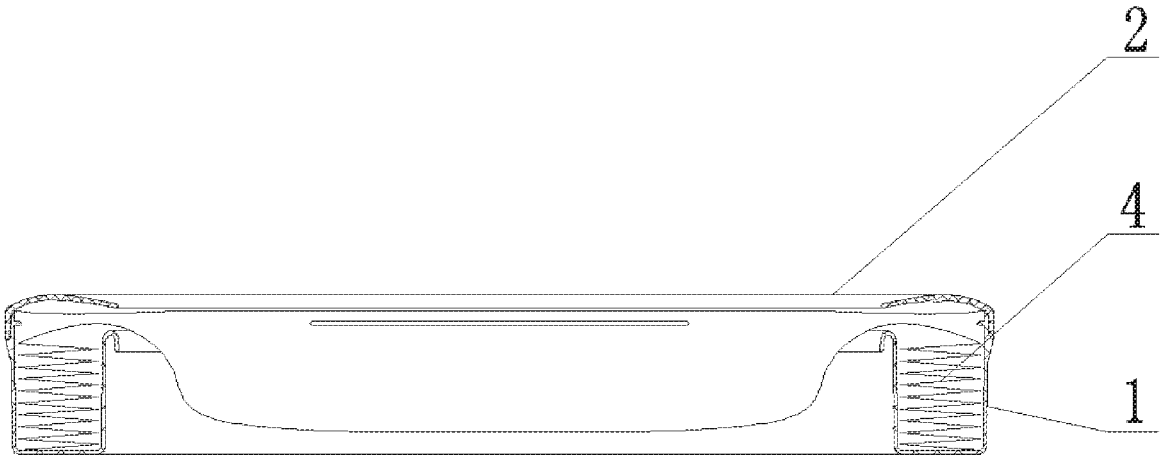
FIG. 2 is a longitudinal cross-sectional view of a trash bag assembly according to an embodiment of the present invention.
Figure 3:
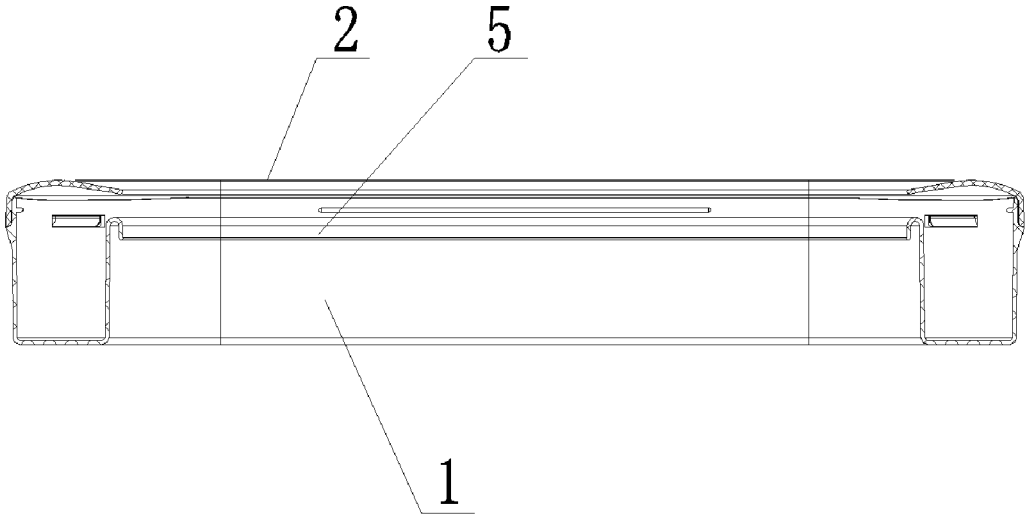
FIG. 3 is a cross-sectional view of a trash bag assembly according to an embodiment of the present invention.

1 denotes a storage body; 2, a lid; 3, an annular trough; 4, a trash bag; 5, a flared edge; 6, a lip; 10, a trash bag assembly; 13, a third opening; 14; a main body of a trash receptacle; 15, a container retainer; 16, a press cover;

20, a flip cover; 21, a panel; 22, an internal bin module; 23, a power cord; 201, a slide track; 202, an ejector; 203, a spring; 204, a stud; 206, a latched position; 207, an ejected position; 208, a locking member;

7, a centrifugal impeller; 8, a motor; 71, a blade; 711, a shoulder; 72, a wheel; 9, a top piece; 91, an air inlet; 92, a post; 30, a bottom piece; 301, a recess; 302, a hole; 303, a screw; 17, a transmitter; 18, a receiver; and R, a fitting device.

DETAILED DESCRIPTION

Exemplary embodiments will be described in detail below, examples of which are illustrated in the accompanying drawings. Whenever mentioned in the following description, the same numbers in different figures represent the same or similar elements, unless otherwise stated. The implementations set forth in the following description of exemplary embodiments do not represent all implementations consistent with the claimed invention. Instead, they are merely some examples of devices and methods consistent with certain aspects of the invention as specified in the appended claims.

Embodiments will be described below with reference to the accompanying drawings. In addition, the embodiments set forth below do not limit the invention as defined by the appended claims in any sense. Further, none of the features described in the following embodiments are considered necessarily essential to the subject matter of the claims attached.

Referring to FIGS. 1 to 5, a trash bag assembly for a smart trash receptacle provided in a particular embodiment includes a storage body 1 and a lid 2. The storage body 1 defines a first opening extending therethrough, and the lid 2 defines a second opening corresponding to the first opening to allow deposition of trash through the first and second openings into the trash receptacle. Herein, the first and second openings are not limited to any size or shape and may be both circular, square or of another shape.

The storage body 1 further defines an annular trough 3 extending externally around the first opening and configured to receive a trash bag 4. The annular trough 3 may have an open end that is open toward the first opening, or away from the first opening, or in the same direction in which the first opening extends. As the size of the annular trough 3 is related to the maximum mass of the trash bags 4 that can be stored therein, it may be sized differently depending on the use frequency and deployment place. If a quite large amount of the trash bag 4 is expected to be used, the annular trough 3 may be configured to have a large storage capacity; and vice versa.

The lid 2 is configured to cover the open end of the annular trough 3 so that the trash bag 4 is confined within the annular trough 3 and can be pulled out only through a bag exit which is an annular gap formed by the lid 2 and one side wall of the annular trough 3. This gap is not limited to, and may have, any particular size as long as its above-described function is enabled.

During use, the annular trash bag 4 is nested in the annular trough 3, with one end thereof being pulled out from the bag exit and closed. In this way, trash bag replacement can be accomplished by a vacuum device incorporated in the trash receptacle. Under the action of the vacuum device, the trash bag 4 can be pushed and automatically fitted into the inside of the trash receptacle by the atmospheric pressure. In order to close the trash bag 4, an automatic bagging mechanism may be activated to drive two pressing bars to narrow and contract the trash bag 4 to a heat fusing device where the trash bag 4 is thermally cut and sealed. The so constructed storage body 1 and the lid 2 can not only restrict the freedom of movement of the trash bag 4 to only one direction, but can also maintain the trash bag 4 in an always open configuration, dispensing with the need to open the trash bag during the automatic trash bag fitting process. As a result, a significantly simpler automatic trash bag fitting and bagging approach allowing easy implementation and operation is entailed.

Therefore, the trash bag assembly can be suitably used in a smart trash receptacle to impart a higher degree of automation and intelligence to it by providing fully-automatic trash bag fitting and bagging capabilities. Moreover, it can effectively prevent damage to the trash bag during its manufacturing, storage and transportation. As the annular trough 3 may be sized differently according to the usage frequency and deployment place of the trash receptacle, the mass of the trash bag stored therein and its bagging length can be easily adjusted to promote resource conservation. Compared with the roll-wise manner, trash bag replenishment can be more easily accomplished with improved efficiency. As the trash bag assembly is an integral structure that can be easily assembled, its manufacturing and assembly can be achieved at lower cost.

Figure 12:
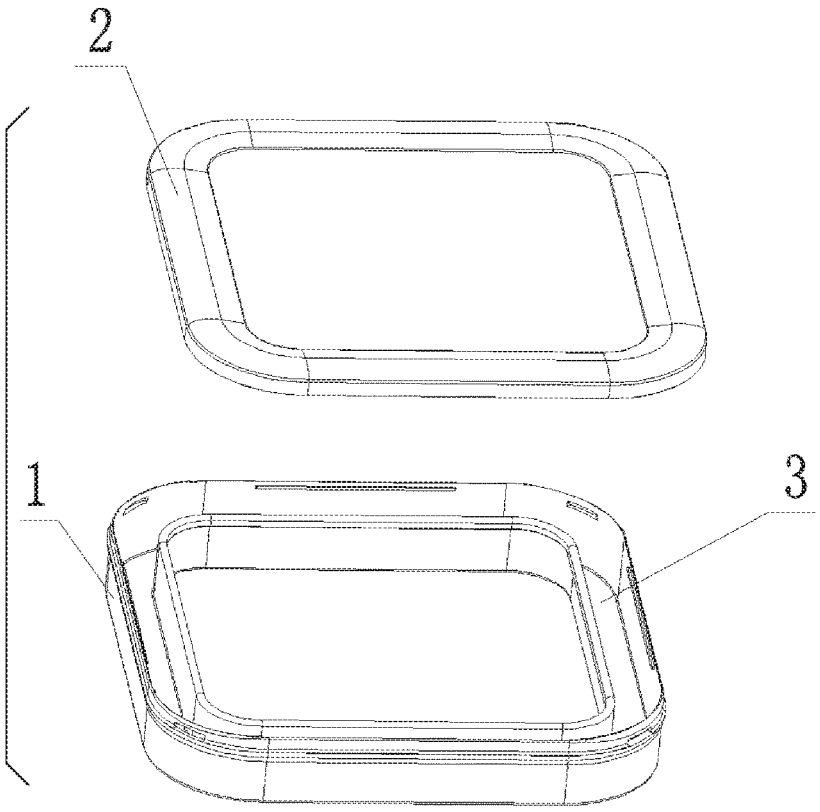
FIG. 12 is a structural schematic view showing a detachable connection between a lid and a storage body according to the present invention.

It should be noted that the lid 2 for covering the open end of the annular trough 3 may be secured by a direct connection to the storage body 1, i.e., integration therewith. In this way, the trash bag assembly can be guaranteed to be stable and reliable. Alternatively, the lid 2 may also be detachably coupled to the storage body 1, as shown in FIG. 12. In this case, the lid 2 may be removed off to facilitate the loading of the trash bag. Of course, it can also be secured in another way.

The trash bag assembly further includes the trash bag 4 that is compliant with the storage body 1 and loadable within the annular trough 3 of the storage body 1. The trash bag 4 may be a tubular structure having a continuous internal lumen extending throughout its entire length and two ends, both of which are open, or one of which is open and the other is closed. In order to be received within the annular trough 3, the trash bag 4 may be reciprocally folded into an annulus dimensionally consistent with the annular trough 3. As the trash bag 4 is an integral piece without weakened portions, it is not limited to any particular length. During use, the trash bag 4 with a proper length can be folded and loaded.

Figure 4:
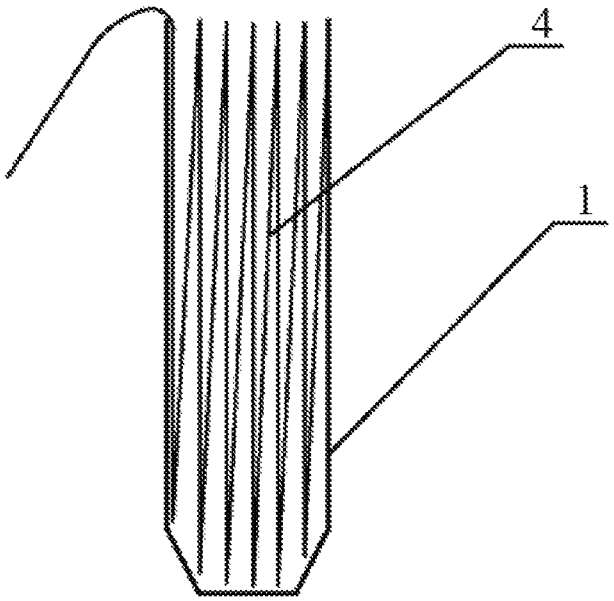
FIG. 4 shows a first folded configuration of a trash bag according to an embodiment of the present invention.
Figure 5:
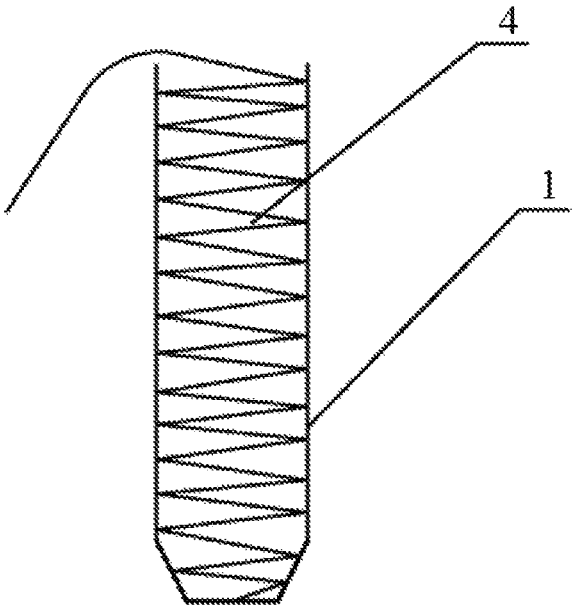
FIG. 5 shows a second folded configuration of a trash bag according to an embodiment of the present invention.
Figure 6:
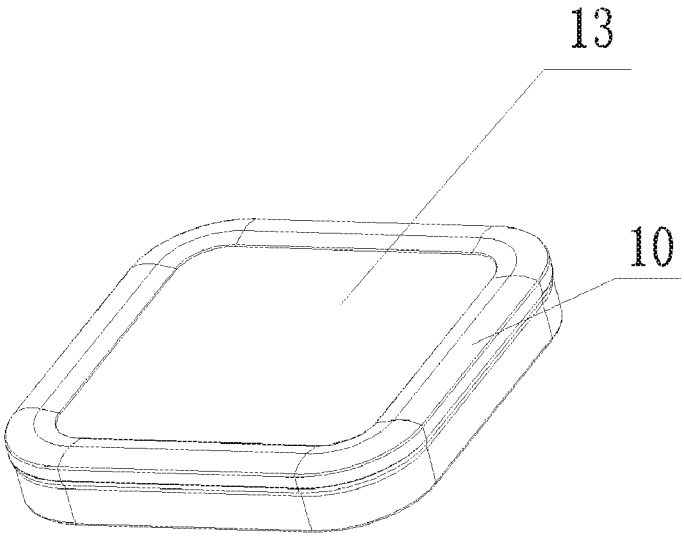
FIG. 6 is a perspective view of a trash bag assembly according to an embodiment of the present invention.

It should be noted that the trash bag 4 may be reciprocally folded as shown in FIGS. 4 to 5, and the direction in which it is folded may be either perpendicular or parallel to the side walls of the annular trough 3 or even oriented otherwise, depending on the actual circumstances.

In use, the weakness-free, integral, tubular trash bag 4 with a desired length and diameter may be axially folded manually or using a proper tool into an annulus which is then placed within the annular trough 3 of the storage body 1, thereby completing the loading of the trash bag 4. Additionally, the trash bag assembly may be placed in position in a corresponding component of the trash receptacle to deploy the weakness-free, integral, tubular trash bag for use. Of course, one end of the trash bag 4 may be pulled out of the annular trough 3 and closed. The closure may be accomplished by, but not limited to, thermoplastic sealing, or by another sealing method, in order to facilitate the automatic use of the initial trash bag segment. Alternatively, the end of the trash bag may not be closed but manually lowered to a certain position where it is automatically closed by the automatic bagging mechanism.

In this way, compared with the conventional trash bags, the trash bag assembly can hold more trash substantially without restrictions. Moreover, it can be sealed and closed at any desired portion, depending on the amount of trash deposited therein, with the remaining length still available for further use. Thus, full utilization of its capacity can be achieved without waste of trash bag resources, and bagging and replacement can be performed in an automated fashion, increasing the degree of automation and intelligence of the conventional smart trash receptacle.

In this embodiment, the side wall of the annular trough 3 that defines the bag exit may have a flared edge 5 that is curved outwardly away from the annular trough 3. The flared edge 5 can guide the trash bag 4 and prevent it from being scratched while it is being pulled out from the bag exit, thereby reducing waste of resources.

In some embodiments, the open end of the annular trough 3 may be open in the same direction in which the first opening extends. In this case, the two side walls of the annular trough 3 can be respectively referred to as an inner side wall and an outer side wall. Wherein, the inner side wall is proximate the first opening and separates it from the interior of the annular trough 3, while the outer side wall is away from the first opening and separates the annular trough 3 from the outside. Thus, the open end substantially extends the entire circumferential length of the interior of the annular trough 3, which is helpful in the loading of the trash bag 4. Moreover, the annular trough 3 can be more firmly connection to the lid 2, helping in increasing the integrity of the trash bag assembly.

Due to the presence of the second opening, the lid 2 has both an inner edge proximate the second opening and an outer edge away from the second opening. Wherein, the gap that provides the bag exit is formed between the inner edge of the lid 2 and the inner side wall of the annular trough 3, while the outer edge of the lid 2 is connected to the outer wall of the annular trough 3. In this way, one end of the trash bag 4 can be pulled out from the bag exit and then closed. In the trash bag fitting process, ambient air can flow in through the second and first openings to push the trash bag 4 into the trash receptacle. Therefore, the trash bag 4 can be segment-wise pulled out from the bag exit, reducing waste of trash bag resources and enabling an always open configuration of the trash bag. This dispenses with the need to open the trash bag during the trash bag fitting process and facilitates automatic trash bag fitting and bagging, imparting to the trash receptacle an increased degree of automation and intelligence.

Of course, in other embodiments, it may also be possible to connect the inner edge of the lid 2 to the inner side wall of the annular trough 3, with the gap providing the bag exit being formed between the outer edge of the lid 2 and the outer wall of the annular trough 3. This arrangement can offer the substantially same beneficial effects and will not be described in further detail herein for the sake of simplicity.

The outer edge of the lid 2 may be pivotably connected at one end to the outer wall of the annular trough 3. Here, the pivotable connection may be provided by a pivoting shaft or a weakened attachment seam. Of course, it may also be established in another possible pivotable form. In this way, the lid 2 can be pivoted to expose the open end of the annular trough 3 to allow the trash bag 4 to be put therein, or to cover the open end of the annular trough 3 to confine the trash bag 4 therein. This entails a simple and easily implementable structure with improved stability.

Further, the lid 2 may define a lip 6 extending along the outer edge and curved toward the outer wall of the annular trough 3. The lip 6 may form an interference fit with the outer wall, by means of which the lid 2 can be firmly fastened over the open end of the annular trough 3, helping in improving the structural stability. Of course, the lip 6 may also be fastened to the outer wall by snap-on means. In this case, the trash bag assembly will have improved integrity and can be assembled or disassembled more easily.

The snap-on means may include a recess and a block in cooperation with the recess. One of the recess and block is provided on an internal side of the lip 6 and the other on the outer wall of the annular trough 3. During movement of the lip 6 toward the outer wall of the annular trough 3, the block can be received in the recess, enabling the snap-on connection. The so constructed snap-on means is easily implementable and operable and can improve the stability of the connection between the lid 2 and the storage body 1.

In some embodiments, both the storage body 1 and the lid 2 may be generally square annuli with chamfered corners. As most trash receptacles are square, such a shape can facilitate the application to those square trash receptacles, allows more firm connection therewith and effectively prevent the rotation and displacement of the trash bag assembly therein. The shape of the trash bag assembly is not limited to a square annulus and may also be a circular annulus or another shape.

The storage body 1 and the lid 2 may be formed of molded plastic parts, or folded pieces of paper that are bonded together, or folded and curved metal members. This ensures easy availability of their materials and can address the requirements of diverse applications. Of course, they may also be made of other materials, depending on the actual circumstances.

The trash bag assembly will be described in detail in conjunction with the above embodiment and its preferred examples.

There is provided herein a trash bag assembly which is a box-like structure with a central opening through which trash can be deposited into a trash bag 4. The box-like structure is an integral structure of the type considered to be composed of a lid 2 and a storage body 1 defining an annular trough 3 for housing the trash bag 4. The lid 2 covers an open end of the annular trough 3 and is thus integrated into one piece with the storage body 1. The lid 2 and the storage body 1 may both be square or circular in shape, depending on the trash receptacle employing the assembly. The box-like structure may be composed either of only one integral component, or of the lid 2 and the storage body that are considered as two separate components assembled together. The lid 2 may be configured to retain the trash bag 4 in the storage body 1 by a tape, a wire or other means. The storage body 1 and the lid 2 may be formed of molded plastic parts, or folded pieces of paper that are bonded together, or folded and curved metal members. The annular trough 3 of the storage body 1 may have an inner side wall defining an annular channel (i.e., a flared edge). However, the annular channel is not limited as being defined by the inner side wall of the annular trough 3, because it may also be defined by the outer side wall or another portion thereof.

Further, the assembly includes the trash bag 4 which is a weakness-free, integral, tubular trash bag optionally with one end being closed to facilitate the automatic initial use subsequent to replenishment. Alternatively, it may remain open at both ends. In order to load the trash bag 4 for use, it may be reciprocally folded axially into an annulus by manual or mechanical means and put in the storage body 1. In generally cases, the storage body 1 may be, but is not limited to, a box-like structure with an opening extending therethrough. It may also be a trough-like structure, a ring-like structure or an applicable retaining frame-like structure. In normal use, the trash bag 4 may be typically housed in an upper portion of the trash receptacle, or in another portion thereof. In particular, the trash bag 4 may be usually folded into an annulus that is disposed flush with an open top of the trash receptacle.

A process for forming the trash bag assembly may include the steps of:

axially folding the weakness-free, tubular trash bag 4 with a length and diameter selected according to the practical need into an annulus manually or using a certain tool;

pressing the folded annular trash bag 4 into a storage space within the annular trough 3 of the storage body 1;

pulling one end of the tubular trash bag 4 out of the annular trough 3 and closing this end by, but not limited to, thermoplastic sealing or by another sealing technique, in order to facilitate the automatic use of the first segment of the trash bag 4; and pivoting the lid 2 so that it covers the open end of the annular trough 3 and is quickly fastened to the storage body 1 by means of its lip 6, thus ending this process.

There is also provided herein a smart trash receptacle including the trash bag assembly as defined above. In doing so, it is easily capable of fully-automatic trash bag fitting and bagging and has a higher degree of automation and intelligence. Moreover, tearing of the trash bag 4 during its manufacturing, storage and transportation can be effectively avoided. As the annular trough 3 may be sized differently according to the usage frequency and deployment place of the trash receptacle, the mass of the trash bag 4 stored therein and its bagging length can be easily adjusted to promote resource conservation. Compared with the roll-wise manner, trash bag replenishment can be more easily accomplished with improved efficiency. As the trash bag assembly is an integral structure that can be easily assembled, its manufacturing and assembly can be achieved at lower cost. Since the smart trash receptacle offers the substantially same beneficial effects as the above-described trash bag assembly, it will not be described in further detail herein for the sake of simplicity.

Figure 13:
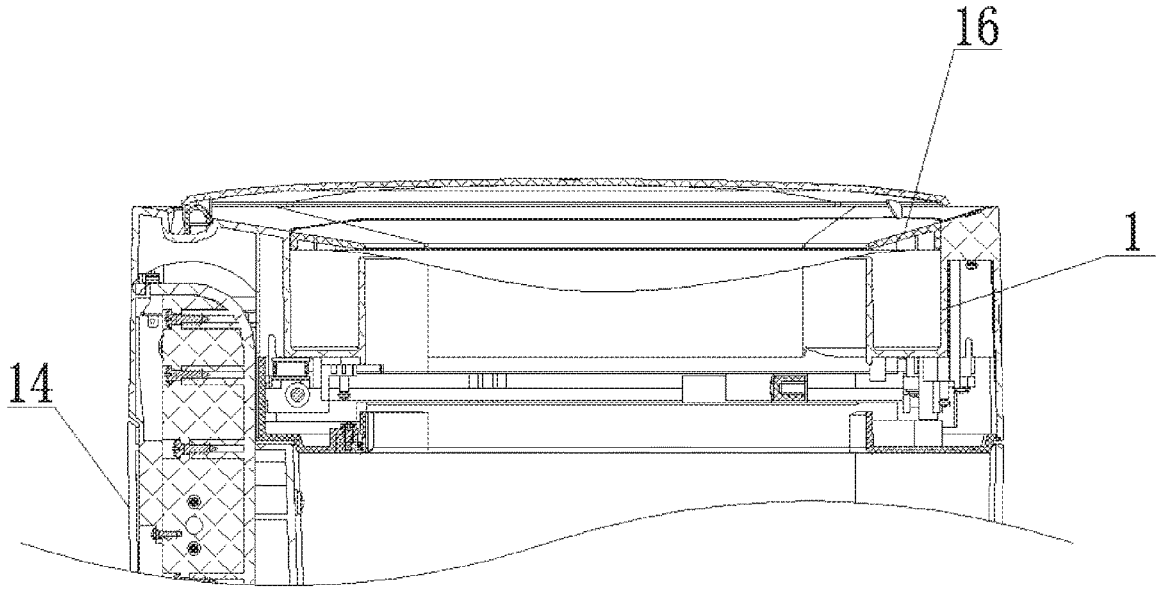
FIG. 13 is a structural schematic view of a storage body integral with a main body of a smart trash receptacle according to the present invention.

Preferably, as shown in FIG. 13, the storage body 1 is integral with the main body of the smart trash receptacle. That is, the storage body 1 and the main body 14 are of a single unitary piece, with a press cover 16 serving as the lid of the trash bag assembly.

Referring to FIGS. 6 to 11, the smart trash receptacle may further include a trash bag assembly locator, wherein the trash bag assembly 10 includes a trash bag container and a trash bag housed therein, and the trash bag container is disposed within the main body 14. In order to allow deposition of trash into the trash receptacle, the trash bag container may have a third opening 13 for the passage of trash. The main body 14 may be provided with a container retainer 15 on which the trash bag container is supported. Further, in order to smooth the deposition of trash into the main body 14, the container retainer 15 may define a fourth opening corresponding to the third opening 13. Furthermore, in order to facilitate the replacement of the trash bag container, the main body 14 may define a channel for the passage thereof.

In addition, the channel may be defined in an upper or lateral portion of the main body 14. In the former case, the emptied trash bag container may be taken out in a height-wise direction of the main body 14, followed by placement of a new trash bag container onto the container retainer 15 in a reverse direction. In the latter case, the container retainer 15 may be laterally pulled out from the trash receptacle, allowing the emptied trash bag container to be replaced with a new trash bag container. After that, the container retainer 15 may be pushed back into the main body 14. In this way, the trash bag container can be easily extracted out while greatly saving the interior space of the trash receptacle. Of course, the channel may also be defined in another portion, depending on the actual circumstances.

With this arrangement, upon the trash bag being used up, the replenishment can be accomplished simply by replacing the emptied trash bag container with another trash bag container loaded with a new trash bag, without the need for dismantlement. Conventionally, when the current trash bag is used up, a new trash bag could be loaded in a storage space in the trash bag container retainer only after the latter is disassembled from the main body 14. After doing so, the trash bag container retainer must be again assembled with the trash receptacle. This disassembly/assembly cycle is a tedious, time-consuming and laborious process.

In preferred examples of this embodiment, the container retainer 15 and the main body 14 may either be provided as a single integral piece or separate pieces, depending on the practical need and actual circumstances.

Figure 7:
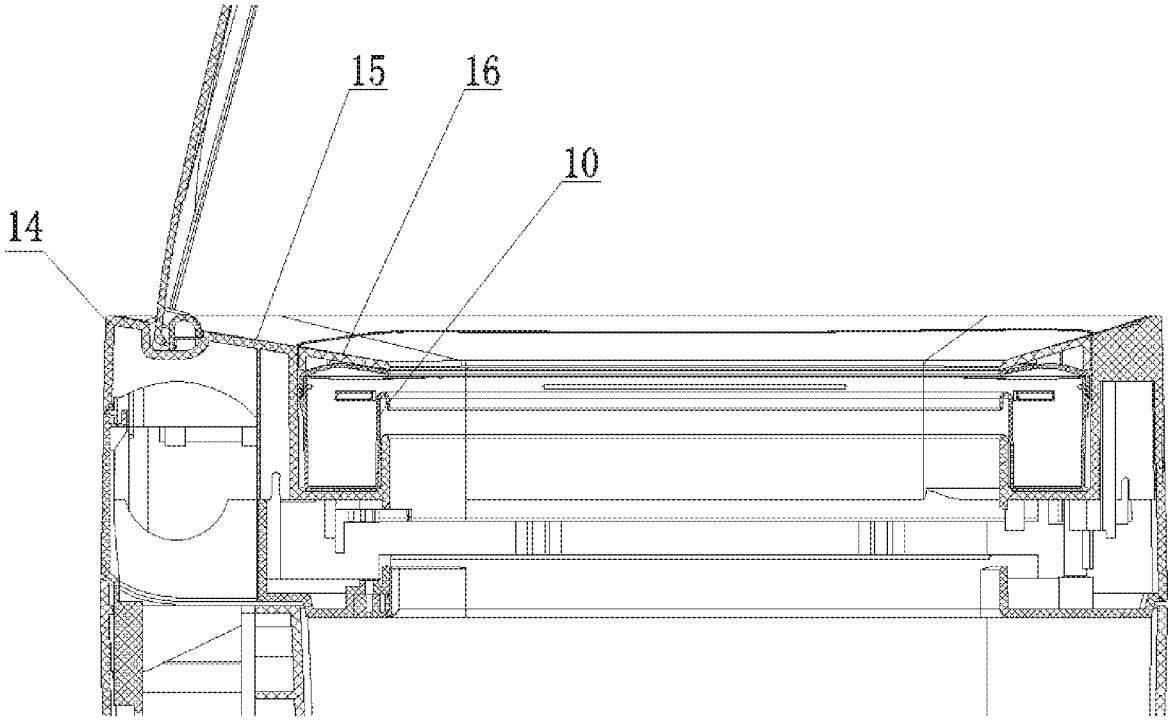
FIG. 7 is a cross-sectional view showing a first alternative embodiment of a trash bag assembly locator according to the present invention.

In a first example, as shown in FIG. 7, the container retainer 15 is integral with the main body 14. In this case, the channel is preferably defined in an upper portion of the main body 14, with the container retainer 15 being implemented as an annular trough extending along an inner circumference of the main body 14 and housing the trash bag. Preferably, the container retainer 15 is disposed on an upper portion of an inner surface of the main body 14. This can save the inner space of the trash receptacle while ensuring smooth extraction of the trash bag.

The locator may further include a press cover 16 for securing the trash bag container. The press cover 16 is configured to be pressed over the trash bag container and may define a fifth opening corresponding to both the third opening 13 and the fourth opening. That is, the press cover 16 may have the same cross-sectional outlines as the trash bag container has. Further, the press cover 16 may be detachably connected to the main body 14.

Further, in this example, an attractive fastener may be disposed between the press cover 16 and the main body 14. In particular, the attractive fastener may be a strongly magnetically attractive fastener including a first magnet disposed on the press cover 16 and a second magnet in the main body of the trash receptacle. The press cover 16 may be pressed over the trash bag container as a result of a magnetic attraction between the first and second magnets.

In this example, the following steps may be followed to replace the trash bag container: opening a flip cover of the trash receptacle; removing the press cover 16; taking out the emptied trash bag container in the height-wise direction of the trash receptacle; putting a new trash bag container onto the container retainer 15 in the reverse direction; and finally laying back the press cover 16, thus completing the replacement so that the trash receptacle is again available for continued use.

Figure 8:
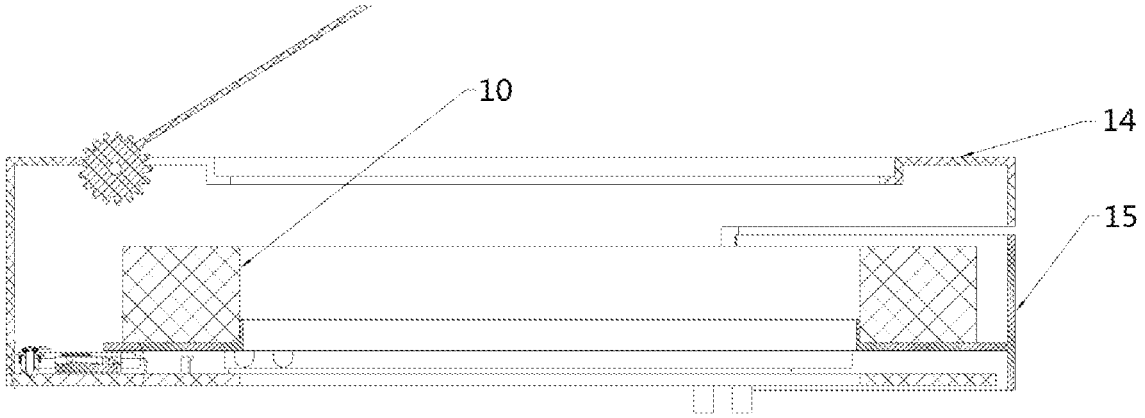
FIG. 8 is a cross-sectional view showing a second alternative embodiment of a trash bag assembly locator according to the present invention.

In a second example, as shown in FIG. 8, the container retainer 15 and the main body 14 are separate components. In this case, the channel is preferably defined in a lateral portion of the main body 14, with a card ejector mechanism or a motor-driven ejector mechanism disposed between the container retainer 15 and the main body 14. The container retainer 15 is able to be ejected from the channel or latched therein by the card ejector mechanism. The motor-driven ejector mechanism may, for example, include a motor and a transmission gear coupled to the motor. The motor is able to push the container retainer 15 out by means of the transmission gear. The motor-driven ejector mechanism may resemble a conventional ejector mechanism used in a CD-ROM disk drive of a computer.

Figure 9:
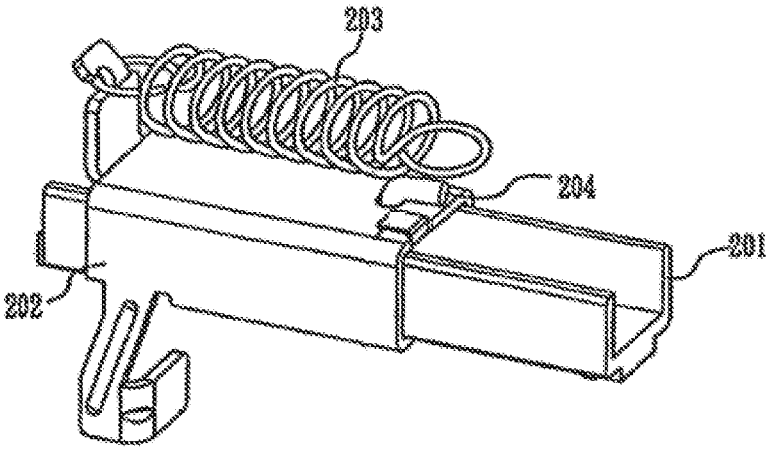
FIG. 9 is a structural schematic view of a card ejector mechanism according to an embodiment of the present invention.
Figure 10:
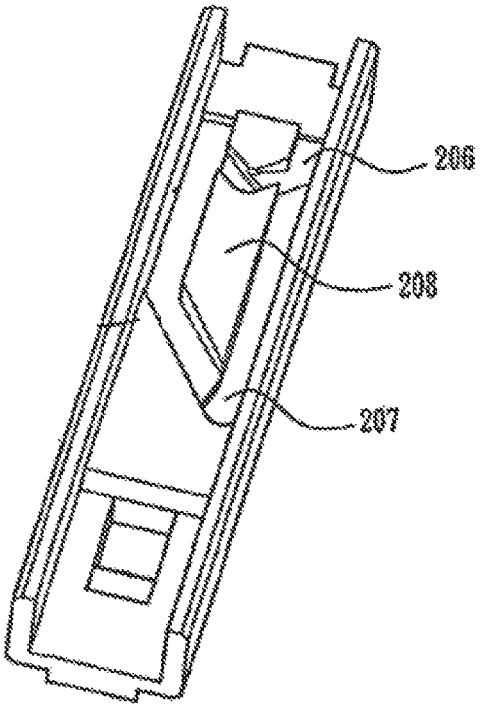
FIG. 10 is an enlarged schematic view of a slide track in a card ejector mechanism according to an embodiment of the present invention.

It should be noted that, in reference to a conventional memory card ejector mechanism, as shown in FIGS. 9 and 10, the card ejector mechanism in this example may specifically include a slide track 201, an ejector 202 and a spring 203. The slide track 201 includes a locking member 208 and defines a latched position 206 and an ejected position 207. The ejector 202 is mounted on the slide track 201 so that it is switchable thereon between the latched position 206 and the ejected position 207, allowing the container retainer 15 to be ejected out. The spring 203 connects the slide track 201 to a stud 204 and is used to provide a resilient force enabling the ejection. When the ejector 202 is pushed on the slide track 201 from the ejected position 207 to the latched position 206, the ejector 202 is hooked on the locking member 208, stretching the spring 203. As a result, the container retainer 15 is hidden and locked in the channel Upon the ejector 202 being released from the locking member 208 as a result of another push thereon, it will return to the ejected position 207, concurrently with the container retainer 15 being ejected out under the action of the resilient force.

Of course, in other examples, it is also possible for the trash bag container to be manually drawn out laterally from the main body 14 or in another manner. This will not be described in further detail herein, and how it is pulled out can depend on the practical need and actual circumstances.

Figure 11:
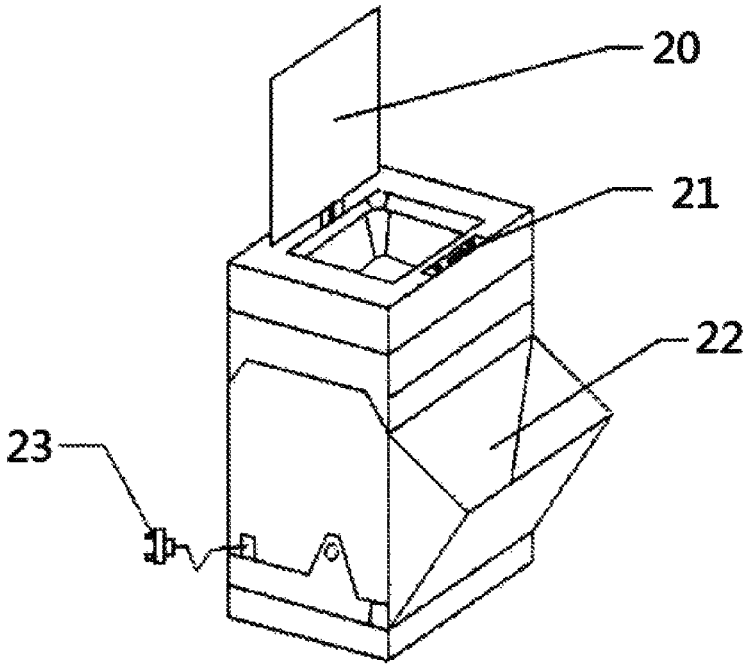
FIG. 11 is a perspective view of a smart trash receptacle according to an embodiment of the present invention.

Specifically, as shown in FIG. 11, operation of the smart trash receptacle according to this embodiment may begin with fully charging its battery using a power cord 23 and deploying it at a desired place. When a user is approaching the smart trash receptacle in order to deposit trash in it, an infrared (IR) sensor module in the smart trash receptacle will sense the user and automatically open the flip cover 20. After the user walks away, the flip cover 20 will be automatically closed. Upon the smart trash receptacle becoming full, a Seal/Renew button on a panel 21 can be manipulated to cause the smart trash receptacle perform, under the control of an MCU therein, the following actions: actuating a motor and a gear train to cause a belt to work with a pulley to drive an electric heating bar to move, so that the weakness-free trash bag is gradually narrowed Immediately before the opposing walls of the bag come into contact, the electric heating bar is energized under the control of the MCU to fuse the trash bag (i.e., cutting it into two pieces). After a while, the power is cut off, and the electric heating bar returns to the initial position. As a result, the segment containing trash is sealed and separated from the trash bag, with the remainder of the latter being still closed at its lower end. The motor then drives an internal bin module 22 to incline outwardly by 45 degrees to expose its open mouth. The cut-off trash bag segment containing trash can then be picked up and taken away by the user. Afterward, with the aid of the battery and under the control of the MCU, the internal bin module 22 of the smart trash receptacle is restored into its initial position, creating a confined space therein. A vacuum device in communication with the trash receptacle at the bottom thereof is then activated to evacuate air from the trash receptacle, resulting in an air pressure within the internal bin module 22 that is much lower than the outside atmospheric pressure. Under the effect of the atmospheric pressure, the trash bag stored in the trash bag container is pulled out therefrom down to the bottom, followed by deactivation of the vacuum device. In this way, trash bag fitting and replacement can be accomplished in the same single automatic process. The user is then again allowed to deposit trash in the trash receptacle.

It should be noted that the terms "first", "second", "third", "fourth", "fifth", etc. as used herein are intended merely to distinguish between elements or functionalities rather than implying any particular sequence or order.

In particular embodiments, a smart trash receptacle and a trash bag fitting device are provided in order to solve the problems of non-automatic or complex bag fitting and inconvenience of use arising from the use of conventional smart trash receptacles.

The embodiments will be described below with reference to the accompanying drawings. In addition, the embodiments set forth below do not limit the invention as defined by the appended claims in any sense. Further, none of the features described in the following embodiments are considered necessarily essential to the subject matter of the claims attached.

Figure 14:
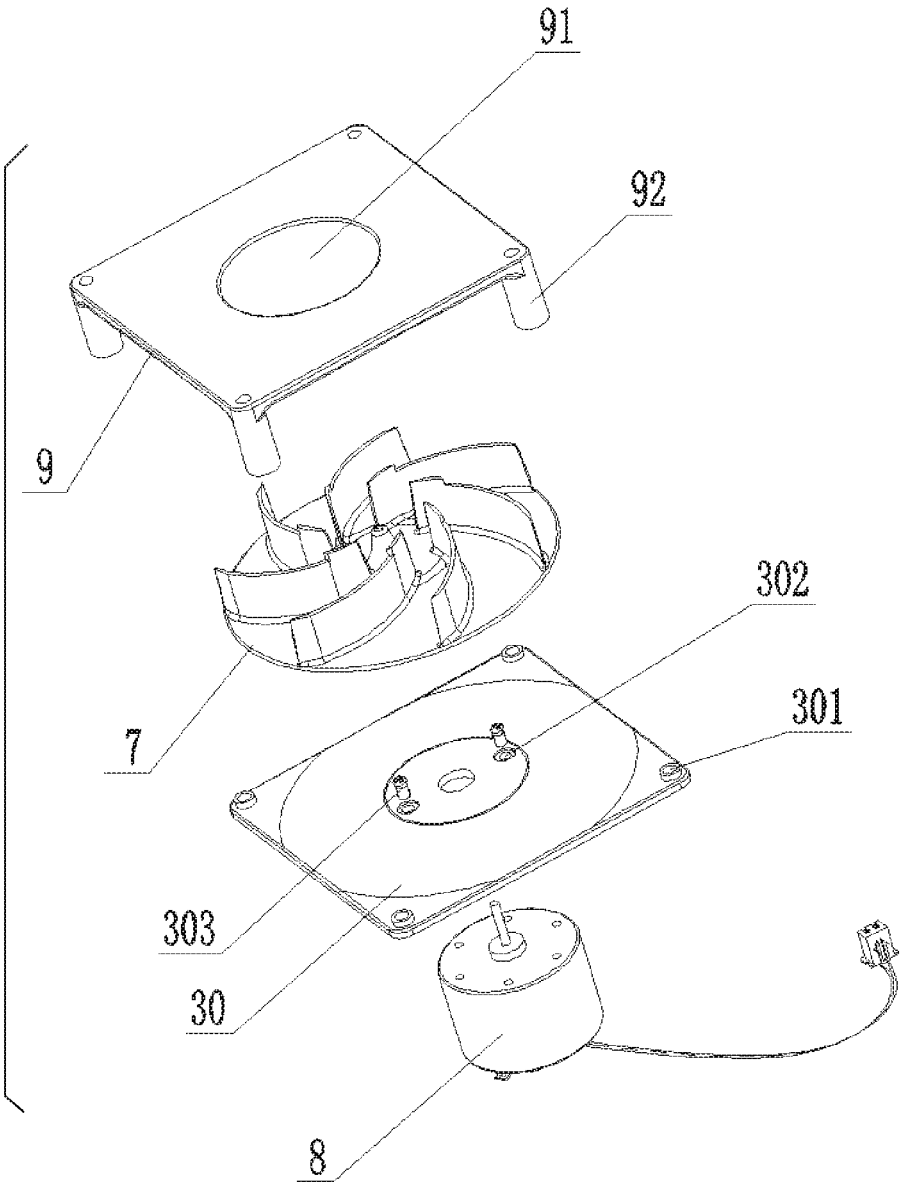
FIG. 14 is an exploded view of a trash bag fitting device according to an embodiment of the present invention.
Figure 15:
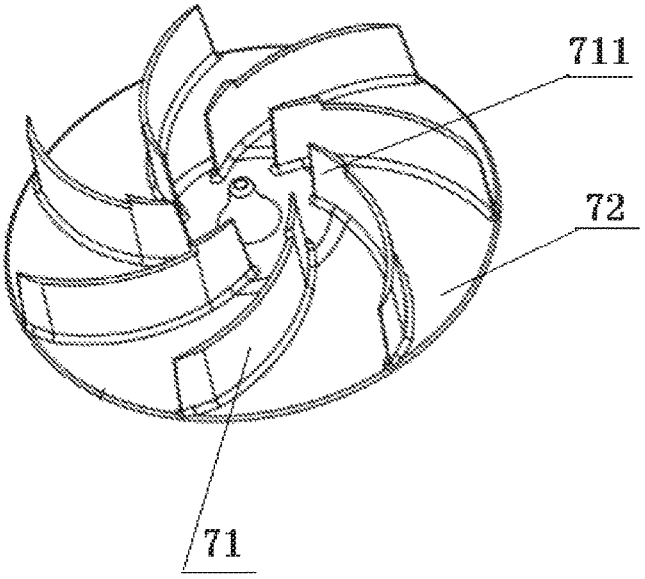
FIG. 15 is a structural schematic view of a centrifugal impeller in a trash bag fitting device according to an embodiment of the present invention.

In reference to FIGS. 14 to 15, the trash bag fitting device for a smart trash receptacle provided in one of such embodiments is configured to fit a trash bag into a main body of the trash receptacle and includes a vacuum assembly and a motor 8 for driving the vacuum assembly. The vacuum assembly defines an air inlet 91 and an air outlet. The air inlet 91 communicates with an air vent in an inner wall of the main body, with the air outlet being in communication with the outside of the main body of the trash receptacle. It operates with the motor 8 driving the vacuum assembly to create a certain degree of vacuum in the main body so that, under the action of atmospheric pressure, the trash bag is uniformly and tightly fitted over internal surfaces of the main body.

It should be noted that the vacuum assembly may be selected as a centrifugal impeller type or axial-flow fan type vacuum assembly or another air pumping assembly capable of air evacuation, depending on the practical need and actual circumstances.

In addition, as shown in FIG. 14, the centrifugal impeller type vacuum assembly may include a casing and a centrifugal impeller 7 housed in the casing. The air inlet 91 is defined in the casing so as to axially oppose the centrifugal impeller 7, while the air outlet is defined therein in so as to radially oppose the centrifugal impeller 7. Moreover, the air inlet 91 communicates with the air vent in the inner wall of the main body and the air outlet with the outside of the main body. When the centrifugal impeller 7 is driven to rotate by the motor 8, air will be evacuated from the main body through the air vent at the bottom thereof so that the ambient atmospheric pressure will be much higher than that in the main body and hence push the trash bag downward. Upon the lower end of the trash bag coming into contact with the bottom of the trash receptacle, the fitting action is completed and motor may then be turned off.

In particular, the centrifugal impeller 7 may have blades 71 each provided with, at a portion thereof in positional correspondence with the air inlet 91, a shoulder 711 projecting toward the air inlet 91. This design allows an increased wind shear area, air intake and suction power, faster air evacuation, reduced time required for vacuum creation, time savings in trash bag fitting and improved operational efficiency.

It should be noted that the shoulders 711 may be sheet-like and have the same thicknesses as the respective blades 71. For the sake of simplicity in their fabrication process, the shoulders 711 may be integral with the respective blades 71. In this way, a greater wind shear area and easy fabrication can be both achieved.

With this arrangement, the problems of non-automatic or complex bag fitting and inconvenience of use arising from the use of conventional smart trash receptacles can be addressed.

In a preferred example of this embodiment, the centrifugal impeller 7 may further include a wheel 72 to which the individual blades 71 are all fixed. As shown in FIG. 15, the blades 71 may be all oriented perpendicular to the wheel 72. In this example, each of the blades 71 may be curved in shape and have an end portion away from a center of the wheel 72 that is thinner than its remaining portion. This design allows effective airflow control and prompt ventilation.

It should be noted that, in one embodiment, the casing may be comprised of a top piece 9 and a bottom piece 30 detachably coupled to the top piece 9. The air inlet 91 may be defined in the top piece 9, with gaps between the top piece 9 and the bottom piece 30 providing the air outlet.

In this example, both the top piece 9 and the bottom piece 30 may be rectangular. In addition, the top piece 9 may be engaged with the bottom piece 30 by snugly inserting at least two posts 92 projecting from a bottom side of the top piece 9 into respective at least two recesses 301 in the bottom piece 30. Specifically, in order to ensure secure engagement, four posts 92 may be provided at the respective corners of the top piece 9.

In this way, the casing appears as a four-sided open structure. Additionally, the air inlet 91 may have a circular cross-section. The centrifugal impeller 7 may operate in a centrifugal manner in which air is sucked in through the circular air inlet 91 and fast discharged from the four open sides of the casing. Of course, the air inlet 91 may also assume a different shape.

Further, the centrifugal impeller 7 may be provided with a shaft hole in which a main shaft of the motor 8 is received and secured. Additionally, the bottom piece 30 may be provided with a hole 302 through which the main shaft is inserted. The bottom piece 30 may be first fastened to the motor 8 with screws 303, and the centrifugal impeller 7 may be then secured to the output shaft of the motor 8. Finally, the top piece 9 may be engaged with the bottom piece 30, thus forming the centrifugal fan.

The so formed centrifugal fan can evacuate the air from the main body of the trash receptacle through the air vent thereof, reducing the pressure therein below the ambient atmospheric pressure. As a result, the weakness-free trash bag is pushed down to the bottom of the receptacle. At this point, the centrifugal fan may be turned off, with the trash bag having been fitted over the internal surfaces of the main body. Therefore, the fitting of the trash bag does not require human intervention, allowing convenience and ease of use.

In one embodiment, there is also provided a smart trash receptacle incorporating the trash bag fitting device as defined above. In this way, the problem of insufficient suction power of centrifugal fans adopted in the conventional smart trash receptacles can be overcome. Since the smart trash receptacle offers the substantially same beneficial effects as the above-described trash bag fitting device, it will not be described in further detail herein for the sake of simplicity.

In this embodiment, the smart trash receptacle may further include a trash bag detection device, which, as shown in FIG. 14, includes a transmitter 17, a receiver 18 and a control mechanism. Both of the transmitter 17 and the receiver 18 are communicatively coupled to the control mechanism, and under the action of the control mechanism, the transmitter 17 can send out a signal which can be received by the receiver 18. In this arrangement, when the trash bag is partially situated between the transmitter 17 and the receiver 18, the signal from the transmitter 17 will be blocked by the trash bag, and the receiver 18 will in response generate a first sense signal and provide it to the control mechanism, based on which control of operational statuses of the individual mechanisms involved in automatic bag replacement is made possible.

Of course, in order for automatic bag replacement to be achieved, the smart trash receptacle is provided with a fitting device R for evacuating air through an air vent. In this embodiment, the fitting device R may be implemented as a centrifugal fan communicatively coupled to the control mechanism. Upon receipt of the first sense signal from the receiver 18, the control mechanism may dictate the centrifugal fan to stop operating.

One of the transmitter 17 and the receiver 18 may be provided on an internal side surface of the trash receptacle and the other on an internal bottom surface thereof. That is, it is either possible that the transmitter 17 is disposed on the internal side surface of the trash receptacle and the receiver 18 on the internal bottom surface thereof or that the transmitter 17 is disposed on the internal bottom surface and the receiver 18 on the internal side surface, depending on actual circumstances. Additionally, the receiver 17 and the transmitter 18 may be on different sides of the air vent. In this way, the sucked air will always traverse between the transmitter 17 and the receiver 18 before it leaves from the air vent. In the trash bag fitting process proceeding under the action of air evacuation by the centrifugal fan, any part of the trash bag will not be situated between the transmitter 17 and the receiver 18 prior to the completion of the process, and accordingly, the receiver 18 will not produce the first sense signal. After the completion of the trash bag fitting process, the trash bag will be present between the transmitter 17 and the receiver 18, triggering generation of the first sense signal by the receiver 18 and deactivation of the centrifugal fan by the control mechanism based on the received first sense signal.

In the case of the transmitter 17 on the internal bottom surface of the trash receptacle and of the receiver 18 on the internal side surface thereof, a central transmission axis of the transmitter 17 may be oriented at an angle $\alpha$ of 30-50 degrees with respect to the internal bottom surface of the trash receptacle, and a central reception axis of the receiver 18 may be oriented at an angle $\beta$ of 38-58 degrees with respect to a vertical direction for the internal side surface of the trash receptacle. As shown in FIG. 14, the vertical direction for the internal side surface is perpendicular to the bottom surface of the trash receptacle. As any reduction in the angle $\alpha$ will increase the possibility of sensing errors that may degrade the positional detection for the trash bag, and since any increase in the angle $\alpha$ will require the receiver 18 to be disposed more distant, which is unfavorable to both the detection and the assembly, this arrangement allows cost savings, easy assembly and higher detection accuracy.

In the case of the receiver 18 on the internal bottom surface of the trash receptacle and of the transmitter 17 on the internal side surface thereof, the central reception axis of the receiver 18 may be oriented at an angle $\alpha$ of 30-50 degrees with respect to the internal bottom surface of the trash receptacle, and the central transmission axis of the transmitter 17 may be oriented at an angle $\beta$ of 38-58 degrees with respect to the vertical direction for the internal side surface of the trash receptacle. As any reduction in the angle $\alpha$ will increase the possibility of sensing errors that may degrade the positional detection for the trash bag, and since any increase in the angle $\alpha$ will require the transmitter 17 to be disposed more distant, which is unfavorable to both the detection and the assembly, this arrangement allows cost savings, easy assembly and higher detection accuracy.

In a preferred example of this embodiment, the angle $\alpha$ is 40 degrees and the angle $\beta$ is 48 degrees. In this way, the distance between the detectors is moderate and good detection results can be obtained, resulting in cost savings and easy assembly.

In this embodiment, both the transmitter 17 and the receiver 18 may be implemented as infrared (IR) devices. That is, the transmitter 17 may be implemented as an IR transmitter and the receiver 18 as an IR receiver. As IR radiation is electromagnetic waves whose wavelengths are between the microwave and visible light spectra, it is highly stable and penetrative in nature. Moreover, the IR transmitter and the IR receiver are inexpensive and helpful in saving cost.

Figure 16:
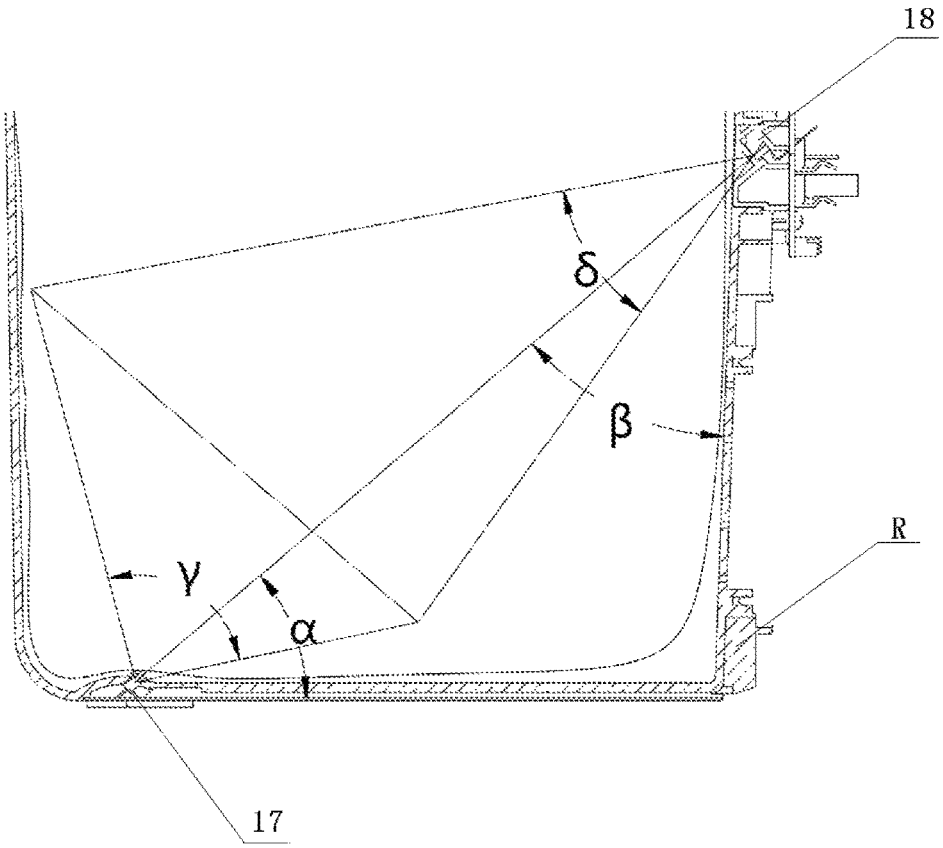
FIG. 16 is a structural schematic view of a trash bag detection device in a smart trash receptacle according to an embodiment of the present invention.

The IR transmitter may be configured to transmit IR radiation at a maximum angle $\gamma$ of 93 degrees, and the IR receiver may be configured to receive IR radiation at a maximum angle $\delta$ of 44 degrees, as shown in FIG. 16. In this way, both the transmission and reception can be performed in a wide angle range, which is conducive to the accuracy of positional detection for the trash bag.

The IR transmitter and the IR receiver may be structurally fixed in terms of both position and angle so as to ensure that the IR transmitter transmits the signal directly toward the IR receiver. Moreover, the IR transmitter and the IR receiver may be structured to so limit the angle of transmission as to avoid the IR signal from propagating through the gap between the trash bag and the bottom of the receptacle to reach the IR receiver. In other words, the IR transmitter and the IR receiver may be both fixed at desired orientation angles on the respective internal surfaces of the trash receptacle by poka-yokes which ensure their positional and angular correctness. The use of such poka-yokes can result in savings in time and labor as well as an improvement in efficiency.

Further, each of the poka-yokes may be comprised of a concave member and a convex member that can be snugly received in the concave member. Additionally, on the internal surfaces of the trash receptacle, cavities that can snugly receive the IR transmitter and the IR receiver and are oriented to limit their aforesaid angles may be formed. One of the concave and convex members may be disposed over an outer surface of the IR receiver or the IR transmitter and the other over an inner surface of a respective one of the cavities. The concave member may extend axially. For example, in the case of the convex member disposed over the outer surface of the IR receiver or the IR transmitter and of the concave member over the inner surface of the respective cavity, the term "axially" is meant to refer to a direction in which the cavity extends. In this way, with the poka-yokes each constructed from such concave and convex members, the IR transmitter and the IR receiver can be both fixed at desired orientation angles with guaranteed positional and angular correctness. As a result, savings in time and labor and improved efficiency can be achieved.

In some embodiments, the IR transmitter and the IR receiver may both be made waterproof and dustproof by means of transparent protective hoods hermetically attached to the internal surfaces of the trash receptacle. Although the IR transmitter and the IR receiver are housed in the protective hoods, positional detection for the trash bag is still possible since the transparent nature of these hoods allows the transmission of IR radiation therethrough. Of course, two protective hoods may be provided respectively for the IR transmitter and the IR receiver, in order for material savings and lower cost to be achieved. Depending on the actual circumstances, the protective hoods may be made of either plastic or glass.

The control mechanism may include a microcontroller unit (MCU) as well as IR Tx/Rx circuitry composed of an amplification circuit, a modulator/demodulator (modem) circuit and the like. The MCU may be configured to produce a modulated carrier signal at 38 KHz and provide it to the IR transmitter. If the carrier signal sent from the IR transmitter is not obstructed by an obstacle (trash bag), it can be successfully received by the IR receiver. When obstructed midway by an obstacle (trash bag), the carrier signal from the IR transmitter will no longer smoothly reach the IR receiver. As a result, the modulated carrier signal arriving at the IR receiver will be very weak or even will not be received at all. In this way, positional detection for the trash bag is made possible.

The carrier signal received at the IR receiver may further undergo gain amplification and demodulation before it is processed and output by a comparator. This imparts very strong interference resistance to the detection, making it normally performable under harsh lighting conditions and under sunlight. The IR transmitter may be configured to transmit the signal at a power level that is so limited to disallow the signal to transmit through the trash bag to arrive at the IR receiver. Upon unsuccessfully receipt of the IR signal at the IR receiver, the presence of the trash bag can be confirmed and the centrifugal fan can be instructed to cease its operation.

In this way, the trash bag detection device is able to detect the position of the trash bag in the trash receptacle and, based on the detected information about the trash bag, control the centrifugal fan so that its operation is maintained and ceased before and promptly after the completion of the trash bag fitting process to avoid the trash bag from being sucked onto the centrifugal fan and broken.

Therefore, the trash bag detection device is helpful in protecting the trash bag, saving resources, reducing potential safety risks of the smart trash receptacle and increasing its stability and reliability.

It should be noted that the terms "top" and "bottom" are referred to herein with respect to the configuration of the trash bag fitting device as shown in FIG. 1.

The foregoing description merely presents a few particular embodiments of the present invention and does not limit the scope thereof in any sense. Any and all variations or substitutions easily devisable by those familiar with the art in light of the teachings disclosed herein are considered to fall within the scope of the present invention. Accordingly, the scope of the invention shall be as defined in the appended claims.

What is claimed is:

1. A trash bag assembly for a trash receptacle, comprising:

a trash bag (4) that is a tubular structure having a continuous internal lumen extending throughout an entire length thereof, and two ends, one of which is open and the other of which is closed;

a storage body (1) defining both a first opening allowing the passage of trash and an annular trough (3) extending externally around the first opening and configured to receive the trash bag (4), the annular trough (3) having an open end; and a lid (2) defining a second opening corresponding to the first opening, the lid (2) being configured to cover the open end of the annular trough (3) so as to form, together with one side wall of the annular trough (3), a gap serving as a bag exit, wherein the annular trough (3) has an inner side wall proximate the first opening and an outer side wall away from the first opening, and the lid (2) has an inner edge and an outer edge, the outer edge being pivotably connected at one end thereof to the outer side wall of the annular trough (3).

2. The trash bag assembly of claim 1, wherein the lid (2) is integral with, or detachably connected to, the storage body (1).

3. The trash bag assembly of claim 1, wherein the trash bag (4) is configured to be reciprocally folded into an annulus so as to be disposed within the annular trough (3).

4. The trash bag assembly of claim 1, wherein the side wall of the annular trough (3) that defines the bag exit has a flared edge (5) that is curved outwardly away from the annular trough (3).

5. The trash bag assembly of claim 1, wherein the open end of the annular trough (3) is open in the same direction in which the first opening extends, and the inner edge of the lid (2) forms the gap, together with the inner side wall, and the outer edge of the lid (2) connected to the outer side wall.

6. The trash bag assembly of claim 5, wherein the lid (2) defines a lip at the outer edge, which forms an interference fit with the outer side wall of the annular trough (3) or is fastened thereto by snap-on means.

7. The trash bag assembly of claim 6, wherein the snap-on means comprise a recess and a block in cooperation with the recess, one of which is provided on an internal side of the lip (6) and the other on the outer side wall of the annular trough (3).

8. A trash receptacle, comprising the trash bag assembly of claim 1.

9. A trash bag fitting device for a smart trash receptacle, the trash bag fitting device configured to fit a trash bag into a main body of the smart trash receptacle, the smart trash receptacle being provided therein with the trash bag assembly of claim 1, the trash bag being accommodated within the trash bag assembly, the trash bag fitting device comprising a vacuum assembly and a motor (8) for driving the vacuum assembly, the vacuum assembly comprising an air inlet (91) and an air outlet, the air inlet (91) in communication with an air vent in an inner wall of the main body of the trash receptacle, the air outlet in communication with the outside of the main body of the trash receptacle.

10. The trash bag fitting device of claim 9, wherein the vacuum assembly is a centrifugal impeller type vacuum assembly or an axial-flow fan type vacuum assembly.

11. The trash bag fitting device of claim 10, wherein the centrifugal impeller type vacuum assembly comprises a casing and a centrifugal impeller (7) housed in the casing, wherein the air inlet is defined in the casing so as to axially oppose the centrifugal impeller (7) and the air outlet in the casing so as to be radially oppose the centrifugal impeller (7) or tangential thereto, and wherein the air inlet (91) communicates with the air vent in the inner wall of the main body, with the air outlet in communication with the outside of the main body of the trash receptacle.

12. The trash bag fitting device of claim 11, wherein the centrifugal impeller (7) comprises blades (71) each provided with, at a portion thereof in positional correspondence with the air inlet (91), a shoulder (711) projecting toward the air inlet (91), the shoulder (711) being sheet-like and integral with the blade (71) on which it is provided, the blades (71) being each curved in shape.

13. The trash bag fitting device of claim 11, wherein the centrifugal impeller (7) further comprises a wheel (72) to which all the blades (71) are fixed and oriented perpendicular.

14. The trash bag fitting device of claim 11, wherein the casing comprises a top piece (9) and a bottom piece (30) detachably coupled to the top piece (9), and wherein the air inlet (91) is defined in the top piece (9), with gaps between the top piece (9) and the bottom piece (30) defining the air outlet.

15. The trash bag fitting device of claim 14, wherein the top piece (9) is provided with at least two posts (92) that project from a bottom side thereof and are snugly insertable into respective at least two recesses (301) defined in the bottom piece (30).

16. The trash bag fitting device of claim 14, wherein the centrifugal impeller (7) is provided with a shaft hole in which a main shaft of the motor (8) is received and secured, and wherein the bottom piece (30) is provided with a hole (302) through which the main shaft of the motor (8) is inserted.

17. The trash bag fitting device of claim 13, wherein each of the blades (71) has an end portion away from a center of the wheel (72) that is thinner than the remaining portion.

18. A trash receptacle, comprising the trash bag fitting device of claim 9.

* * * * *